US009022831B2

(12) United States Patent
Moore

(10) Patent No.: US 9,022,831 B2
(45) Date of Patent: May 5, 2015

(54) MODULAR BUILDING SYSTEM

(71) Applicant: Innovative Toys, LLC, Flagstaff, AZ (US)

(72) Inventor: Scott Keegan Moore, Flagstaff, AZ (US)

(73) Assignee: Innovative Toys, LLC, Flagstaff, AZ (US)

( * ) Notice: Subject to any disclaimer, the term of this patent is extended or adjusted under 35 U.S.C. 154(b) by 48 days.

(21) Appl. No.: 14/057,650

(22) Filed: Oct. 18, 2013

(65) Prior Publication Data

US 2014/0113522 A1 Apr. 24, 2014

Related U.S. Application Data

(60) Provisional application No. 61/715,516, filed on Oct. 18, 2012.

(51) Int. Cl.

| | |
|---|---|
| ***A63H 33/00*** | (2006.01) |
| ***A63H 33/04*** | (2006.01) |
| ***A63H 33/08*** | (2006.01) |

(52) U.S. Cl.

CPC ..... *A63H 33/04* (2013.01); *A63H 33/08* (2013.01)

(58) Field of Classification Search

USPC ..... 446/105, 106, 108, 111, 112, 113, 114, 446/116, 124, 125

See application file for complete search history.

(56) References Cited

U.S. PATENT DOCUMENTS

| | | | | | |
|---|---|---|---|---|---|
| 1,281,856 | A * | 10/1918 | Shaw | 446/112 |
| 1,894,605 | A * | 1/1933 | Wright | 446/122 |
| 2,041,069 | A * | 5/1936 | Jones et al. | 446/105 |
| 2,874,512 | A * | 2/1959 | Joseph et al. | 446/106 |
| 4,270,302 | A * | 6/1981 | Dandia | 446/105 |
| 4,709,640 | A * | 12/1987 | Jouanin | 108/91 |
| 4,740,188 | A * | 4/1988 | Coster | 446/114 |
| 4,792,319 | A * | 12/1988 | Svagerko | 446/104 |
| 4,825,620 | A * | 5/1989 | Johnson | 52/646 |
| 5,185,982 | A * | 2/1993 | Hostetler | 52/646 |
| 5,281,181 | A * | 1/1994 | McCollum | 446/106 |
| 5,282,343 | A * | 2/1994 | Stein | 52/233 |
| 5,322,467 | A * | 6/1994 | Barzani | 446/125 |
| 6,189,271 | B1 * | 2/2001 | Christensen | 52/233 |
| 6,558,222 | B1 * | 5/2003 | Maddock | 446/105 |
| 7,118,442 | B2 * | 10/2006 | Laliberte et al. | 446/85 |
| 8,317,564 | B1 * | 11/2012 | Buhrman | 446/108 |
| 2003/0208979 | A1 * | 11/2003 | Sorensen et al. | 52/591.1 |

* cited by examiner

*Primary Examiner* — Kurt Fernstrom

(74) *Attorney, Agent, or Firm* — Woods Oviatt Gilman LLP; Ronald J. Kisicki, Esq.

(57) ABSTRACT

A modular building set having a plurality of interlocking members comprising a plurality of planks and a plurality of posts. The planks each comprise a central plank member having two pairs of opposing recesses and four pairs of opposing parallel bars with two pairs of bars located equidistant one another on either the recesses. The posts each comprise a central post member with a pair of opposing central recesses depending from the upper and lower edges. The posts each have two pairs of opposing bar members with one set of bar members between the opposing central recesses and a first end a post, and another set of bar members between the opposing central recesses and a second end opposite said first end. The plank and/or post members interlockably engage one another by joining a recess of a first member with the recess of the second member.

16 Claims, 5 Drawing Sheets

MODULAR BUILDING SYSTEM

CROSS-REFERENCE TO RELATED APPLICATIONS

This application claims the benefit of U.S. patent application Ser. No. 61/715,516, filed Oct. 18, 2012, which is hereby incorporated by reference in its entirety.

BACKGROUND OF THE INVENTION

The present invention is generally related to the field of building systems. More particularly, the present invention is directed to building toys, and even more specifically to building toys where a child can construct, and then play on, the resulting structures. Alternatively, the invention could be used for other structures such as a compost bin, or a dog or horse training apparatus, etc. The present invention comprises a plurality of interlocking planks and posts which may be assembled in a multitude of potential configurations.

BRIEF SUMMARY OF THE INVENTION

In general, one embodiment of the present invention is directed to a modular building system having a plurality of interlocking members comprising a plurality of only two components, the two components being a plank and a post. The planks each comprise a central plank member having two pairs of opposing recesses depending from the upper and lower edges of the plank. A first pair of opposing recesses is situated near the first end of the plank and a second pair of recesses is situated near the opposing end. The planks further comprise four pairs of opposing generally parallel bar members wherein a first and second pair of bar members is located equidistant one another on either side of the first pair of recesses, and wherein a third and fourth pair of bar members is located equidistant one another on either side of the second set of recesses. Similarly, the posts each comprise a central post member having a pair of opposing faces with a pair of opposing central recesses depending from the upper and lower edges of the central post member. The posts each have two pairs of opposing bar members with one set of bar members between the opposing central recesses and the left end, and another set of bar members between the opposing central recesses and the right end. The plank and/or post members interlockably engage one another by joining a recess of a first member with the recess of a second member. By interlockably engaging one or more of the two components, a multitude of configurations of the modular toy system can be assembled.

In a preferred embodiment, two members are joined at a 90° angle with the 90° arrangement being further secured by a locking interaction between opposing bar members. The interlocking bar members prevent closing or opening of the angle created by the two members. The recess and bar members present on the planks and posts of the present invention provide secure interlocking of adjacent pieces while also enabling quick and easy dismantling and reassembly of the members. In a preferred embodiment, the plank members are constructed to have a length in the range of 2 to 4 feet with a width of 6 to 12 inches and thickness of 1 to 3 inches, with the post members having a length between 6 and 12 inches and a width and thickness equal to that of the plank members. It should be understood by those skilled in the art that the plank members and post members can be constructed to have any desired dimensions as dictated by the circumstances and the above recitation is not to be construed as limiting the present invention in any way.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
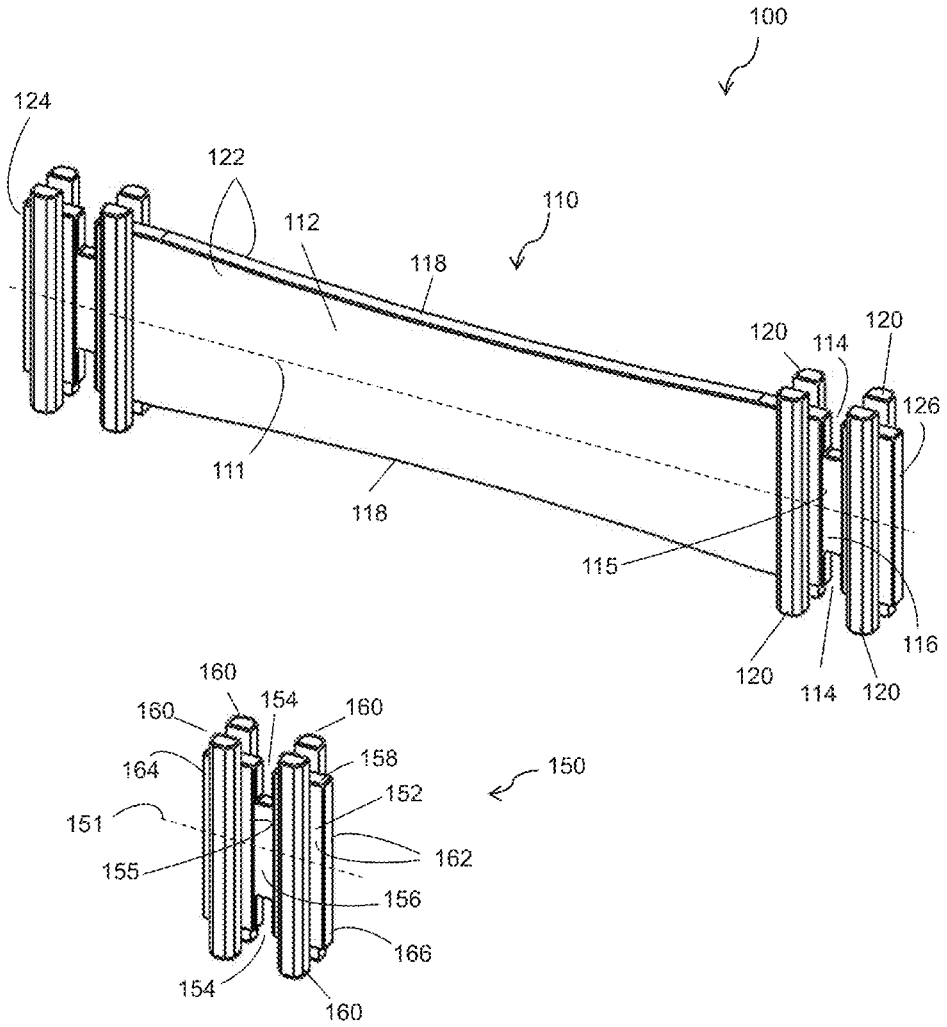
FIG. 1 is a perspective view of a building system according to the present invention, including a plank and a post.

Referring to the drawings in detail, and specifically to FIG. 1, an interlocking system of building toys 100 is generally comprised of a plurality of planks 110 and posts 150. Each of the plank and posts has a central member, 112 and 152, respectively, having at least one pair of opposing recesses 114 and 154, respectively, depending from edge 118 and 158, respectively, having opposing faces 122 and 162, respectively, and forming a bridge 116 and 156, respectively. Plank 110 has one pair of opposing recesses proximate one end 124, and has a second pair of opposing recesses proximate the second end 126. The post has a pair of opposing recesses centrally located along the edges 158 of the central member between a first end 164 and a second end 166 of the post. In preferred embodiments, the width of recesses 114 and 154 is slightly less than the overall thickness of central members 112 and 152. Bridges 116 and 156 are configured to have a thickness essentially equal to the width of the recesses so as to allow a bridge of a first member to engage with and fit snuggly within the recess of a second member. This reduced thickness of bridges 116 and 156 generate channels having sides 115 and 155, respectively within central members 112 and 152, respectively. In this manner, two members can only be interlocked together at the recess/bridge joint. The thinner recess cannot span any other portion of the edge of a plank or post. Opposing pairs of generally parallel bars are secured proximate each recess perpendicularly to the horizontal plane 111 or 151 created by central member 112 and 152, respectively. In preferred embodiments, each pair of opposing recesses has two pairs of parallel bars equidistant one another on either side of the pair of recesses. Thus, recesses 114 are bracketed by bars 120 while recesses 154 are bracketed by bars 160.

Figure 2:
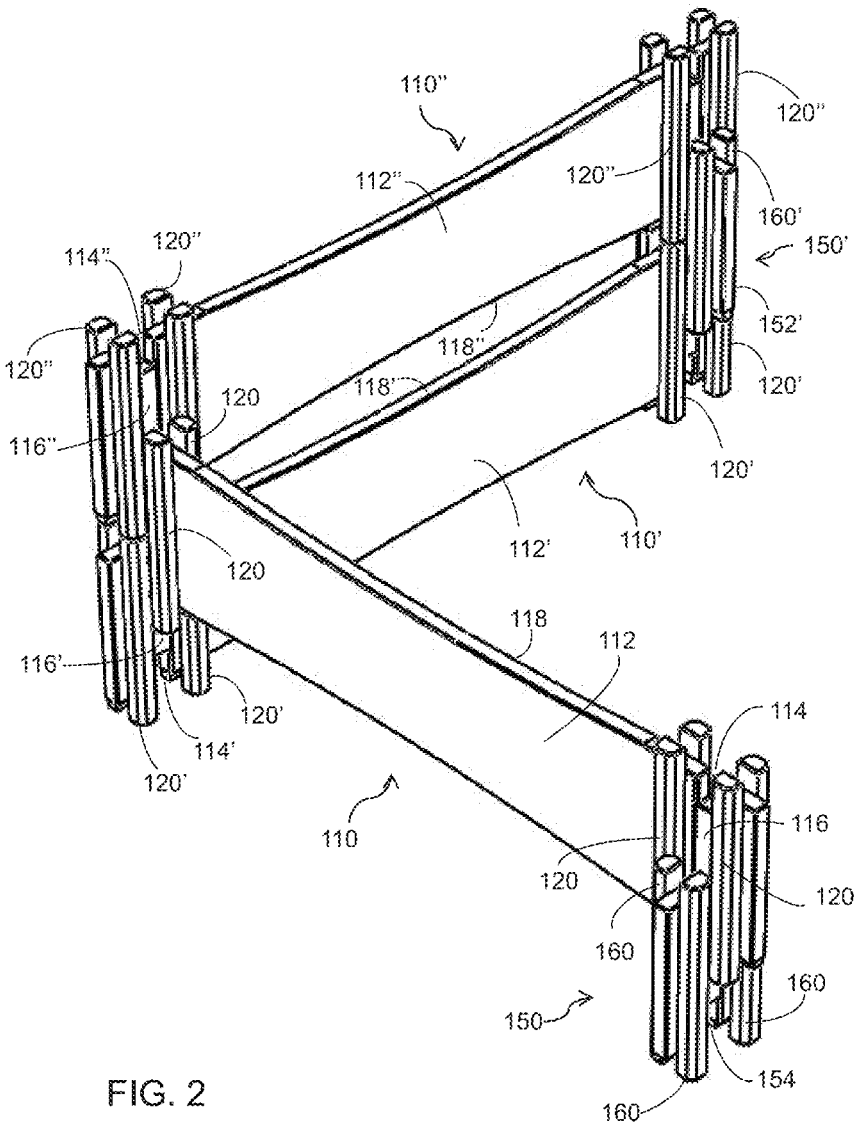
FIG. 2 is a perspective view showing examples of interconnectivity between members of a building system in accordance with the present invention.

Turning now to FIG. 2, an exemplary view of various modalities of interlocked connectivity between plank and post members is shown. The exemplary view is comprised generally of a first post 150' securing the first ends of parallel planks 110' and 110"; the first end of a first plank 110 secured between the two parallel planks 110' and 110"; and a post 150 acting as a base for a second end of plank 110. In describing the relationship between perpendicular planks 110' and 110", each plank has a first end releasably secured by an interlocking post 150'. As shown, the recess/bridge portions of alternating plank 110'/post 150'/plank 110" are dimensioned such that post 150' fits snuggly within the respective recesses of the two planks such that bars 120' and 120" contact one another, or very nearly contact one another while the post is centered between the planks. As such, interlocking mating surfaces between the three members is maximized thereby creating the most stable mating position. As post 150' has its central member 152' positioned normal to planks 110' and 110", post 150' prevents shifting of the planks in the direction parallel to the plane created by members 112' and 112". Further, the interaction between bars 120', 120" and 150' prevent inward or outward tipping of one or both planks in a direction perpendicular to the plane created by members 112' and 112". Therefore, the first end of planks 110' and 110" are interlockably secured by post 150' with disassembly possible only by applying an upward force to either plank 110" or post 150' in the view shown.

Similarly, the second ends of parallel planks 110' and 110" are interlockably secured together. However, rather than through a post 150' as in the case of their first ends, the perpendicular member at each plank's 110' and 100" second end is a third plank 110. As can be seen, a first end of plank 110 is fitted between plank 110' and 110" by mating the opposing recesses at the first end of plank 110 within the opposing recesses in each of the second ends of planks 110' and 110". In preferred embodiments, the ends of each plank are proportioned identically to the recess and bars of posts 150 and 150'. This connectivity maintain planks 110' and 110" in a parallel relationship to one another which also receiving optimal interlocking mating from either a post or a third plank.

A further example of an interlocking arrangement between members is demonstrated by the connectivity of plank 110 and post 150. In this case, post 150 acts as a base for the plank and the interlocking relationship is identical to that described above with reference to post 150'. By having generally identical proportions between the planks and posts, post 150 supports plank 110 such that plank 110 remains level when mounted at the opposing end between planks 110' and 110". It is important to maintain level such that bars 120/120'/120" and 160/160' remain a parallel relationship with one another and maximize interlocking contact along the entire length of these bars. If plank 110 were to become non-level, bars 120 would only contact one set of bars 120' or 120", with such contact being at only one edge of bar 120. This single point of contact would create an unsecure structure while also increasing wear to the bars and planks as force would be directed laterally to a smaller area of the bar and plank rather than being distributed downwardly at the overlap between the respective bridges.

Figure 3:
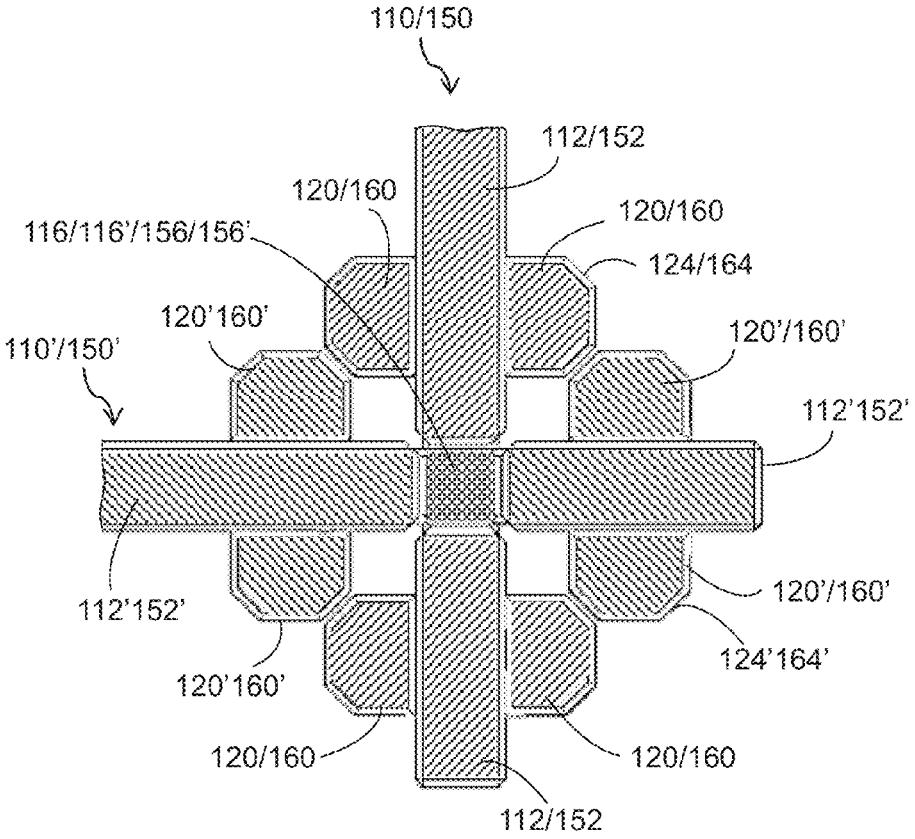
FIG. 3 is an enlarged top view of the overlapping connectivity of two members of a building system in accordance with the present invention.

Referring now to FIG. 3, a detailed top view of the interlocking configuration of any two planks 110/110', posts 150/150' or combinations thereof is shown. As can be seen, a first plank or post 110/150 mates with a second plank or post 110'/150' having central members 112/152 and 112'/152' in a generally 90° orientation to one another such that bridges 116/116'/156/156' overlap as described above with regard to FIG. 2. In a preferred embodiment, each of bars 120/120'/160/160' are spaced proximate their respective bridge but at a distance sufficient to allow contact between opposing bars when the bridges are overlapped. Each bar is adapted to include a chamfered edge 124/124'/164/164' to provide increased surface area between mating bars. This increased surface area further stabilizes the mating and assists in preventing collapse or expansion of the desired 90° orientation. While shown and described as having the bars spaced from the recesses and possessing a chamfered edge, alternative designs are contemplated. These include, at one extreme, providing non-chamfered bars having sharp edges wherein the bars are spaced sufficiently distal the recess so as to create a joining surface limited to the edge of opposing bars. As discussed above, while this design may interlock the two members, this single edge of contact provides minimal surface contact and may allow for expansion or collapse of the angle, particularly after wear and tear. Alternative, and at the other extreme, the bars may be place immediately adjacent the recess and have a tapered edge from one corner to the opposing diagonal corner so as to form a triangular shaped bar. However, while this approach maximizes overlap between surfaces of opposing bars, the relative location of the bars' proximity to the recesses allows for some degree of flexion between the two members, thereby generating a less secure construction. Further, in each of these extremes, bars are created having a sharp edge which is undesirable for use in toys designed for children.

Figure 4:
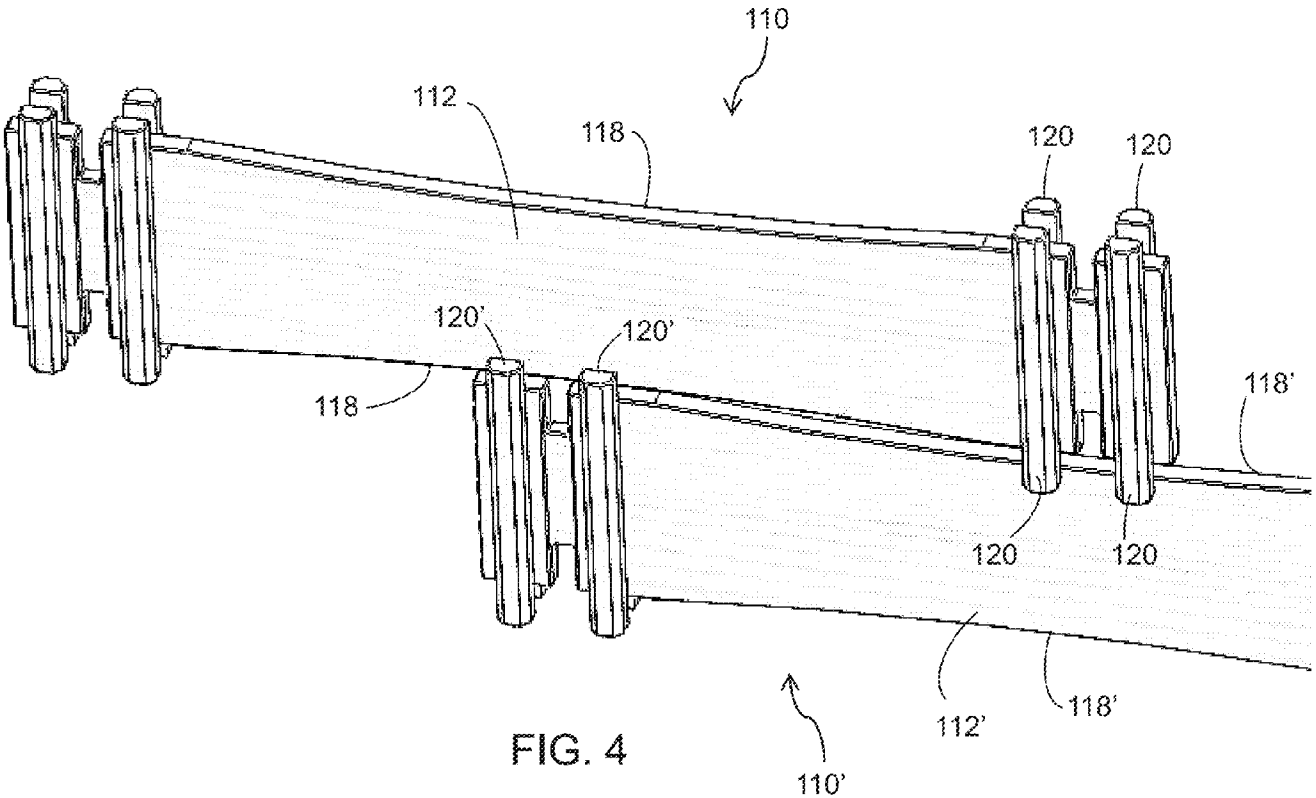
FIG. 4 is a perspective view showing a further example of interconnectivity between members of a building system in accordance with the present invention.

FIG. 4 illustrates an alternative coupling of two planks 110 and 110' within the same vertical plane without the use of a post member. This alternative coupling has edge 118 of plank 110 inserted between bars 120' of plank 110' while edge 118' of plank 110' is inserted between bars 120 of plank 110. In a preferred embodiment, edges 118 and 118' are curved so as to create planks with a face 112 and 112', respectively, having concave upper and lower profiles. These concave profiles assist a user of the present system in directing bars 120 and 120' generally to the center of the opposing plank when two planks are joined in the same vertical plane as shown in FIG. 4, thereby affording the greatest degree of stability. An alternative plank design includes each plank having only one concave edge where two planks are stacked atop one another so that the curved edges are proximate one another and each plank's flat edge is distal the union between the two members. Again, these curved edges assist in creating a stable construction by encouraging joining of the two planks so that any two sets of bars are spaced equidistant to any next set of bars. Although not preferred, additional systems may include plank members having flat edges (i.e. so as to form a generally rectangular plank with the exception of the one or more pairs of opposing recesses). However, in this system, the flat edges will facilitate stacking of two or more planks having bars in non-optimal locations. For instance, the two planks may be arranged such that the bars of the first plank contact the bars of the second plank. Thus, security of the joint is generally isolated to a single area along the edges of the two planks. This single overlap area will subject the plank to a greater possibility of pivoting upwardly or downwardly, or tipping inwardly or outwardly.

Figure 5:
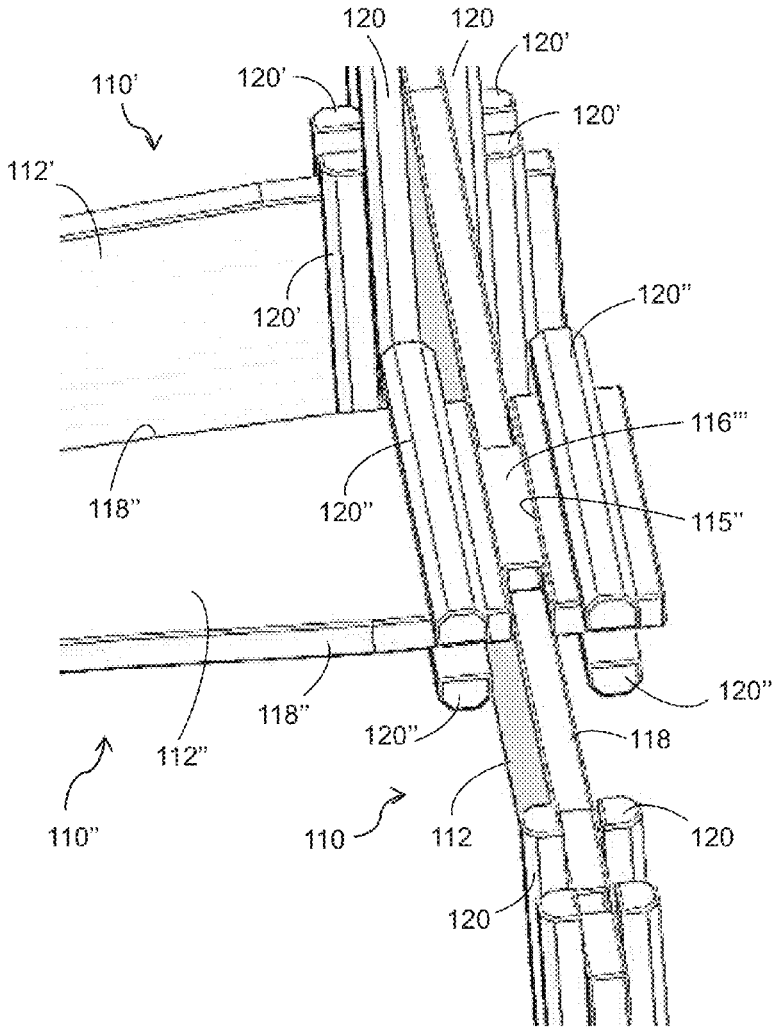
FIG. 5 is a perspective view of yet a further example of interconnectivity between members of a building system in accordance with the present invention.

With attention directed to FIG. 5, an additional example of the joining of two planks is shown. In this example, a first plank 110 is set up so that face 112 has a vertical orientation with an upper edge 118. First plank 110 is secured in this position by additional planks and/or posts, such as second plank 110', as described above with regard to FIG. 2. Ideally, each end of plank 110 is secured by use of an additional plank or post. With plank 110 thus situated, a further plank 110" may be laid across edge 118 of plank 110 such that plank 110" is lying in a general horizontal plane with reference to plank 110 so as to form a ramp (i.e. with only one end mounted to a vertical plank) or a platform (i.e. with one end mounted onto a first vertical plank and the second end mounted onto a second vertical plank). Plank 110" is positioned such that edge 118 of plank 110 rests between an opposing pair of bars 120" of plank 110". As described earlier with regard to FIG. 1, bridge 116" has a width which is slightly narrower that the thickness of edge 118. As such, plank 110" rests on end 118 along the entire width of face 112". This maximized contact assists in preventing sideways tipping of plank 110", particularly when a force is applied proximate either edge 118". Additionally, channel edge 115" helps prevent perpendicular displacement of plank 110" from edge 118. Should channel edge 115" become dislodged, perpendicular deconstruction is further prevented by the lower pair of bars 120".

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A modular building set having a plurality of interlocking members comprising:

a plurality of planks, each plank comprising:

a) a central plank member having opposing top and bottom edges, a first end and a second end, and opposing front and back faces;

b) at least one pair of opposing recesses positioned proximate either end of said central plank member wherein a top recess depends from said top edge and a bottom recess depends from said bottom edge; and c) at least one pair of generally parallel opposing bars mounted generally perpendicular to a long axis of the plank and between said at least one pair of opposing recesses and said first end, wherein a first bar member is affixed on said front face and a second bar member is affixed on said back face.

2. The building set of claim 1, wherein said at least one pair of opposing recesses is two pairs of opposing recesses, wherein a first pair of opposing recesses is positioned proximate said first end and a second pair of recesses is positioned proximate said second end, wherein a second top recess depends from said top edge and a second bottom recess depends from said bottom edge.

3. The building set of claim 2, wherein the distance between said first pair and said second pair of recesses is greater than the distance between said first pair of recesses and said first end and between said second pair of recesses and said second end.

4. The building set of claim 1, wherein said at least one pair of generally parallel opposing bars is four, wherein a first pair of bars and a second pair of bars are located equidistant one another on either side of said first pair of recesses, and wherein a third pair of bars and a fourth pair of bars are located equidistant one another on either side of said second set of recesses.

5. The building set of claim 1, wherein one or both of said top and bottom edges curve inwardly so as to create a plank having at least one concave edge.

6. The building set of claim 1, wherein exterior edges of each bar member are chamfered.

7. The building set of claim 1, wherein each bar member extends beyond said top edge and said bottom edge of said central plank member a distance substantially equal to one-half the depth of each recess.

8. The building set of claim 1, wherein a portion of the central plank member located between said pair of opposing recesses is thinner than the remainder of said central plank member.

9. The building set of claim 8, wherein the portion of the central plank member located between said pair of opposing recesses has a thickness substantially equal to a width of said pair of opposing recesses.

10. The building set of claim 1 further comprising a plurality of posts, each post comprising:

a) a central post member having opposing upper and lower post edges, a left post end and a right post end, and opposing front and back post faces;

b) a pair of opposing central recesses wherein a top post recess depends from said upper post edge and a bottom post recess depends from said lower post edge; and c) two pairs of generally parallel opposing post bars, each pair of post bars having a first post bar member affixed on said front post face and a second post bar member affixed on said back post face, wherein a first pair of post bars is located between said opposing central recesses and said left end and a second pair of post bars is located between said opposing central recesses and said right end.

11. The building set of claim 10, wherein exterior edges of each post bar member are chamfered.

12. The building set of claim 10, wherein each post bar member extends beyond said upper post edge and said lower post edge of said post a distance substantially equal to one-half the depth of each central recess.

13. The building set of claim 10, wherein a portion of the post located between said pair of opposing central recesses is thinner than the remainder of said post.

14. The building set of claim 13, wherein the portion of the post located between said pair of opposing central recesses has a thickness substantially equal to a width of said pair of opposing central recesses.

15. An interlockable post for use in a building set, said post comprising:

a) a central post member having opposing upper and lower post edges, a first post end and a second post end, and opposing front and back post faces;

b) opposing central recesses including a top post recess depending from said upper post edge and a bottom post recess depending from said lower post edge; and c) a pair of generally parallel opposing post bars wherein a first post bar is affixed on said front post face and a second post bar is affixed on said back post face, wherein said pair of post bars is located between said opposing central recesses and one of said first or second post ends.

16. An interlockable plank for use in a building set, said plank comprising:

a) a central plank member having opposing top and bottom edges, a first end and a second end, and opposing front and back faces;

b) opposing recesses positioned proximate said first end of said central plank member wherein a top recess depends from said top edge and a bottom recess depends from said bottom edge; and c) a pair of generally parallel opposing bars mounted generally perpendicular to a long axis of the plank and between said opposing recesses and said first end, wherein a first bar member is affixed on said front face and a second bar member is affixed on said back face.

* * * * *